US008147344B2

(12) United States Patent
Crawford et al.

(10) Patent No.: US 8,147,344 B2
(45) Date of Patent: Apr. 3, 2012

(54) AMUSEMENT PARK RIDE WITH CABLE-SUSPENDED VEHICLES

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 157 days.

(21) Appl. No.: 12/796,390

(22) Filed: Jun. 8, 2010

(65) Prior Publication Data

US 2011/0300957 A1 Dec. 8, 2011

(51) Int. Cl.
*A63G 31/16* (2006.01)
*A63G 31/00* (2006.01)

(52) U.S. Cl. ..... 472/59; 472/130; 434/55; 104/112; 105/150

(58) Field of Classification Search ..... 472/49, 472/50, 59, 75–78, 80, 130; 434/29, 55; 104/112, 113, 117, 117.1; 105/30, 148, 150, 105/151
See application file for complete search history.

(56) References Cited

U.S. PATENT DOCUMENTS 3,333,713 A * 8/1967 Cruciani ..... 212/76
3,353,503 A * 11/1967 Pettit ..... 105/150
3,457,876 A * 7/1969 Holden ..... 104/89
3,847,085 A * 11/1974 Rypinski ..... 104/122
4,641,587 A * 2/1987 Dalliard ..... 105/3
6,189,455 B1 * 2/2001 Thompson ..... 104/112
6,406,299 B1 * 6/2002 Murao et al. ..... 434/29
6,511,381 B1 1/2003 Cochron
6,648,102 B2 11/2003 Bostelman et al.
6,808,459 B2 10/2004 Checketts
7,624,684 B2 * 12/2009 Morris ..... 104/112

OTHER PUBLICATIONS

Tadokoro, Satoshi, et al., A Motion Base with 6-DOF by Parallel Cable Drive Architecture, IEEE/ASME Transactions on Mechatronics, vol. 7, No. 2, Jun. 2002, pp. 115-123.

* cited by examiner

*Primary Examiner* — Kien Nguyen
(74) *Attorney, Agent, or Firm* — Marsh Fischmann & Breyfogle LLP; Kent A. Lembke

(57) ABSTRACT

A ride system for moving a passenger vehicle through a dynamically-defined work space. The system includes a track structure that guides one or more motorized or driven carriers on the track structure. The system includes winches on the carrier(s) that are independently operable to set lengths of the vehicle supporting cables, which extend outward from the winches to the vehicle. During operation, the winch systems provide upper anchor points for suspending the passenger vehicle such that these anchor points are selectively positioned. The winches may be independently operated as the carrier(s) travels from a first position to a second position, such that the vehicle body pitches, rolls, or yaws and moves transversely relative to the track. The winches may be operated concurrently to drop or raise the vehicle to define the work space for the vehicle in the vertical direction. Passenger input may interactively control motion of the vehicle.

22 Claims, 8 Drawing Sheets

AMUSEMENT PARK RIDE WITH CABLE-SUSPENDED VEHICLES

BACKGROUND

1. Field of the Description

The present description relates, in general, to theme or amusement park rides that have cable-suspended passenger or guest vehicles, and, more particularly, to systems and methods for selectively changing the position and/or the orientation of vehicle bodies or vehicles within a work or show space using two or more winches or cable drives to suspend the vehicles a selectable distance from each winch/cable drive and with one or more of the winches/cable drives supported by a carrier moving on one or more tracks (e.g., one or more winches has a movable/positionable anchor point to allow for a variable workspace for the ride vehicle. The elevation of the vehicle, the orientation of the vehicle (roll, pitch, and yaw), and its X-Y coordinates when viewed from above may be varied along the length or path of the track by operation of the winches/cable drives.

2. Relevant Background

Amusement parks continue to be popular worldwide with hundreds of millions of people visiting the parks each year. Park operators continuously seek new designs for thrill and other rides because these rides attract large numbers of people to their parks each year. However, most parks also have strict space limitations such that rides with smaller footprints are often more attractive to park operators. In theme and other parks, in addition to high-speed or thrill portions of rides, many rides incorporate a slower portion or segment to their rides to allow them to provide a "show" in which animation, movies, three-dimensional (3D) effects and displays, audio, and other effects are presented as vehicles proceed through such show portions. The show portions of rides are often run or started upon sensing the presence of a vehicle and are typically designed to be most effective when vehicles travel through the show portion at a particular speed. As a result, it is preferable that vehicles are selectively positioned along a track near show elements, can be oriented towards specific show elements, and have the ability to vary/control the speed at which the vehicles travel, e.g., faster during thrill portions and slower during show portions.

Motion simulators have been popular rides for much of the past twenty years. During this time period, though, the general configuration of the rides has changed very little and these rides have several major drawbacks. First, the rides attempt to simulate a feeling of weightlessness, but this is not possible for more than a brief interval as sustained acceleration is constrained to 1 G at some angle relative to the guests/passengers except for very short intervals that are limited by an actuator length or stroke. Second, the ride capacity and/or cycle time is dependent on load time since the motion base and the show environment occupy the same physical space, which forces an undesirable "spill/fill" loading scenario. For example, a ride may take the form of a cable-suspended flight simulator or the like in which the winches supporting the vehicle are rigidly anchored to support structures above the vehicle and the vehicle moves through a fixed volume or space during the ride. Guests/passengers typically load and unload from the same general location. The fixed location of the vehicle results in a limited show space for the ride, which may be thought of as a third limitation of such rides. A fourth limitation is that the physical space required for a conventional motion simulator ride is directly proportional to the actuator stroke.

Hence, there remains a need for improved amusement or theme park rides that provide large show space and that provide new and exciting ride experiences such as by including longer weightless portions, by providing rapid side-to-side and/or vertical position movements, and/or by allowing passenger control over vehicle positioning/movements. Other benefits of such a system may include the fact that the vehicle is following a progammed or guest-controlled path. This allows for many opportunities to vary or customize the path to the preference of the passenger/rider (e.g., thrill level, story branches, exploration opportunities, and the like).

SUMMARY

The present invention addresses the above problems by providing a ride that provides cable-suspended passenger vehicles that may be moved through a ride environment within a variable work space. Briefly, the ride includes one or more tracks that define a path(s) for a ride, and each vehicle is suspended by two or more winches or cable drives that can selectively adjust the length of a cable attached at a support/attachment point on a body of the vehicle (e.g., two, three, or more spaced-apart cable-attachment locations on each vehicle body). The winches may be fixed in place or mounted on individual carriers or mounted on a single carrier, with each carrier being motor or otherwise driven on the track to allow the carriers and the anchor points for the suspension cables to be moved during the ride. By selective operation of the winches and positioning of the carrier(s), the vehicle can be positioned at numerous X-Y positions within the facility (e.g., looking downward on the ride) as well as in numerous Z or vertical positions relative to the track. As a result, the vehicle may be moved through a large work space or volume, and, through the use of differing cable lengths (which may be dynamically set) the orientation of the vehicle body may also be adjusted during the ride (e.g., to provide pitch, yaw, roll, and the like).

More particularly, a ride system is provided for moving a passenger vehicle through a dynamic work space (e.g., moving a payload along a path defined by a track but with a varying work space below the track by moving suspension or anchor points and/or altering lengths of supporting cables). The system includes a track defining a fixed path for the ride system and also a carrier supported on the track. The carrier or bogie is designed with typical amusement park ride equipment (drive devices) to move along the fixed path from a first position to a second position during operation of the ride system. The system further includes first and second winch systems mounted on the carrier. The first and second winch systems are independently and concurrently operable to set a length of a first cable and a length of a second cable. These cables extend outward from the first and second winch systems to a passenger vehicle that has a body with first and second attachment points for the first and second cables. During operation of the system, the first and second winch systems provide first and second points for suspension of the passenger vehicle that move along the fixed path provided by the track.

Typically, in the ride system, the first attachment point is distal to the second attachment point on the body (e.g., 1 to 5 feet or more apart) such that the body pitches or rolls when the length of the first cable differs from the length of the second cable. In some cases, the first and second winch systems are operated concurrently at a same rate such that the lengths of the first and second cables are equal as the carrier travels from the first position to the second position, and, in this manner, the body is maintained in a fixed horizontal position over a range of vertical distances from the track (e.g., passengers provided a level ride even though the vertical distance and work space are changing). In the ride system, the first and second winch systems may be operated independently as the carrier travels from the first position to the second position, such that the body pitches, rolls, or yaws between the first and second positions.

In some embodiments, the ride system includes a third winch system mounted on the carrier controlling a length of a third cable extending from a third suspension point on the carrier to a third attachment point on the body of the passenger vehicle, and the first, second, and third winch systems are independently and concurrently operable. In such a system, the second and third attachment points may be spaced apart and provided on a first end of the body and the first attachment point is provided on a second end of the body. The ride system may in other embodiments include third, fourth, fifth, and sixth winch systems mounted on the carrier and controlling lengths of third, fourth, fifth, and sixth cables attached at opposite ends to third, fourth, fifth, and sixth attachment points on the body of the passenger vehicle. In such an embodiment, positions of the winch systems on the carrier and positions of the attachment points on the body may be selected such that the winch systems are operable as a Stewart platform-type rigging for moving the body relative to the track.

According to another aspect, a ride assembly is provided with a track defining a path and, in this assembly, first and second carriers are supported on the track that are independently driven to position the first and second carriers at differing positions along the path defined by the track. Also, in this assembly, first and second winch systems are positioned on the first and second carriers, respectively, and operate to define lengths of first and second cables. Additionally, the assembly includes a passenger vehicle with a body having first and second attachment points for the first and second cables. The first and second attachment points may be proximate to each other and a center of gravity of the body, and the first and second winches may be concurrently operated to maintain the length of the first cable substantially equal to the length of the second cable. In other cases, though, the assembly is configured such that the path defined by the track is an enclosed loop. In such embodiments, the winch systems may be operable to position the body of the passenger vehicle in a plurality of positions in a work space defined by the loop and a vertical distance extending below the track. Further, the winch systems may be independently and concurrently operable to set the lengths of the first, second, and third cables such that the lengths are each selectable from a predefined range to be equal or to differ during movement of the carriers along the path and at the differing positions. In this implementation, one or more winch systems may be fixed/hard mounted to the track since only one of the cable anchor points has to be moved to vary the work space.

In other embodiments, the assembly may further include a second rail spaced apart two or more distances along a corresponding two or more portions of the path, with the first carrier supported on the second rail. In this embodiment of the assembly, a fourth carrier may be supported on the second rail that is independently driven relative to the first, second, and third carriers. Additionally, a fourth winch system may be positioned on the fourth carrier that is independently operable to define a length of a fourth cable attached to the body of the passenger vehicle at a fourth attachment point. Then, the first, second, third, and fourth attachment points may be spaced apart and arranged in a rectangular pattern on a surface of the body. In the same or other embodiments, at least one of the lengths of the first, second, third, and fourth cables may differ during movement of the carriers from the other three lengths at least during a portion of the path defined by the track so as to provide differing movements and/or orientations of the vehicle during the ride.

According to another aspect of the description, a method is provided for positioning a vehicle relative to a track in an amusement park ride. The method includes suspending a vehicle for passengers using at least two cables extending from anchor points on one or more carriers supported by a track. The anchor points are each defined by an outlet of a winch. The method also includes driving the one or more carriers along a track, whereby the vehicle is moved through a work space below the track. Then, the method includes, during the driving, operating at least one of the winches to change a length of a corresponding at least one of the cables. In this way, the method includes dynamically modifying the work space as the vehicle is moved along the track. In the method, the driving and the operating steps may be performed in response to control signals from a control system, with the control signals at least partially being derived from user input provided by one of the passengers in the vehicle.

In the method, at least three cables may be used in the suspending step. Then, during the operating step, each of the three winches associated with the cables may be independently operable such that at least three differing ones of the lengths for the cables are defined, whereby the work space is dynamically modified and an orientation of the vehicle relative to the track is also modified during the driving. In other cases, in the method, at least six cables may be used in the suspending with attachment points being selected on the body such that the operating step may be performed to control positioning of the body relative to the track as a suspended Stewart platform. In some cases of the method, two or more carriers may be used during the suspending step. Then, during the driving step, each of the two or more carriers may be driven at differing velocities. In other cases of the method, though, each of the winches may be operated during the operating step to modify the lengths of the cables, and, in such cases, the winches may be operated such that the lengths of the cables are modified at differing rates.

DETAILED DESCRIPTION

Briefly, embodiments of the present invention are directed to systems, and associated methods, for amusement park rides with cable-suspended passenger vehicles. In its simplest form, the rides may be thought of as moving a payload through a working environment that is unique because the payload is suspended to provide a variable (selectable) and/or dynamic work space as the suspension assembly/system may be operated to control where the vehicle is positioned in the X-Y positions (e.g., looking downward on the ride) and also its Z or vertical position relative to a track. A conventional tracked ride has a fixed relationship with the track (or a relatively static workspace) while the systems and methods described herein allow the vehicle to be controlled, by ride control systems and/or user input, to explore space below the supporting track or guide rails. Briefly, this is achieved using movable anchor or suspension points for each vehicle in the form of one or more winch or cable drives on one or more carriers or mobile platforms, which are supported by the track(s) and, typically, are independently movable or positionable along the track.

Figure 1:
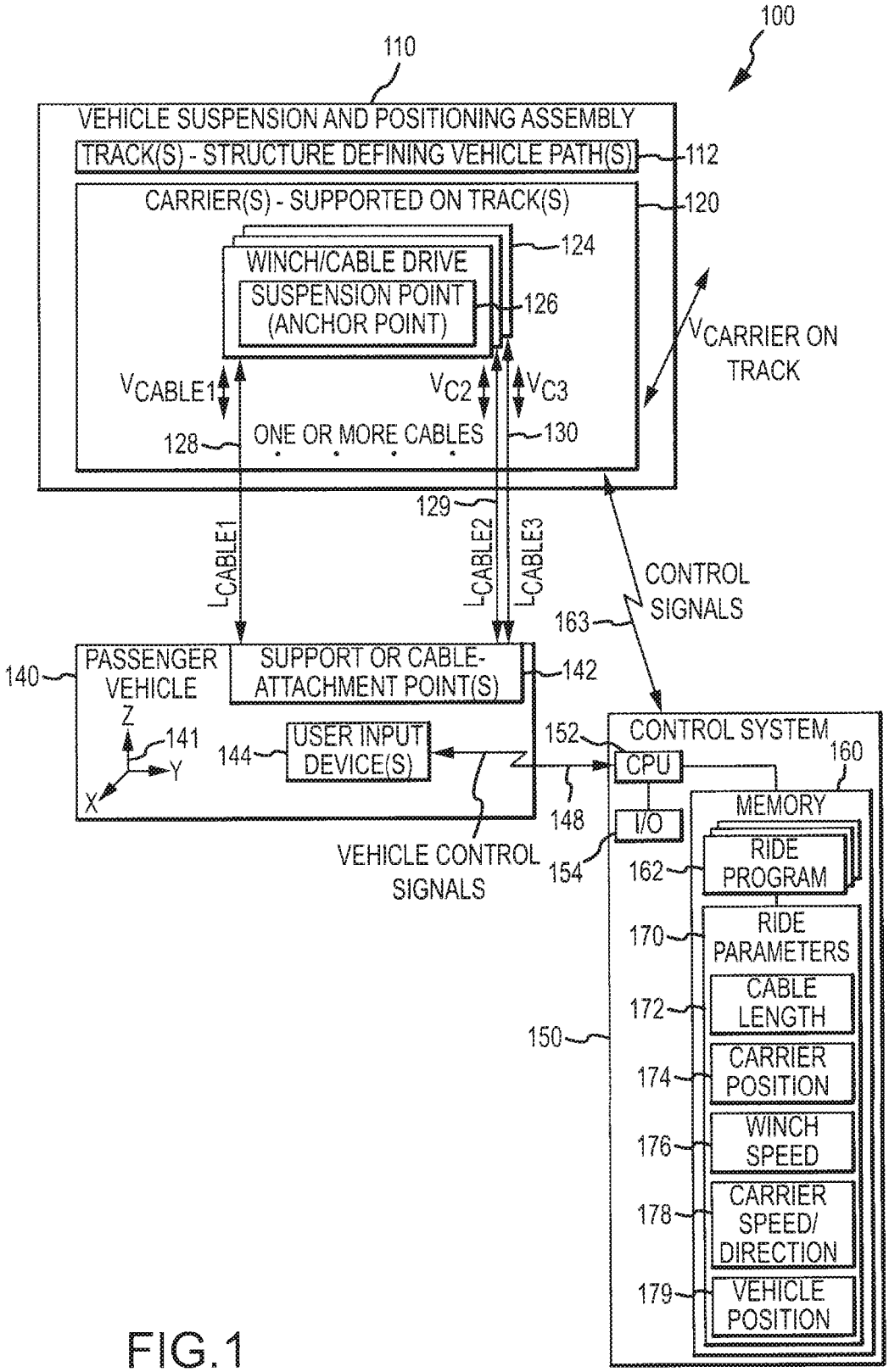
FIG. 1 is a functional block drawing of an amusement park ride that uses cable-suspended vehicles so as to provide efficient positioning and unique motion of the vehicle as it travels along a track (e.g., with moving or positionable anchor points for cables used for suspending the vehicle with variable length cables)

FIG. 1 illustrates in functional block form an amusement park ride 100 that is adapted to allow vehicles to be moved in three dimensions (X-Y-Z positioning) relative to a supporting carrier that travels along a fixed path (e.g., a path defined by a ride track). The ride 100 includes a vehicle suspension and positioning assembly 110 that functions to support passenger vehicles as shown with vehicle 140, to move the vehicle 140 along a ride path, and to also move the vehicle in the X-Y axes (looking downward on a ride) and Z-axis (vertical positioning relative to the supporting carrier). To this end, the assembly 110 includes one or more tracks 112 that may be nearly any structure that defines a path for the vehicle 140 through a ride 100 such as one, two, or more rails or the like as is common in amusement park rides.

The assembly 110 also includes one or more carriers 120 that are supported (e.g., rollable) on the track 112. Each carrier 120, in turn, carries or supports one or more winches or cable drives 124 that each provide a suspension or anchor point 126 for a cable with FIG. 1 showing cables 128, 129, 130 extending from each winch 124 such as from a like number of suspension/anchor points 126. During operation of the ride 100, the carrier 120 may be moved at one or more velocities ($V_{Carrier}$) on the track 112 to dynamically set the location of the anchor or suspension points 126 (i.e., the anchor points are not fixed for the vehicle 140). Further, each of the winches 124 is independently operable to change the length of the cables 128, 129, 130 at the same or differing uptake/unwind velocities (as shown by $L_{Cable}$ and $V_{Cable}$), which depending upon the number and location of the cables 128, 129, 130 results in the vehicle 140 being moved in the X-Y-Z positions as shown at 141 in FIG. 1. In other words, the vehicle 140 is selectively positionable relative to the track 112 (or ride pathway) to define a variable workspace for the ride 100.

The passenger vehicle 140 includes support or cable-attachment points 142 of a like number as the number of cables 128, 129, 130, and, typically, the cables 128, 129, 130 are fixed to a structural surface of a body of the vehicle 140 such as with a fixed, pivotal, or swivel connection. The vehicle 140 may also include one or more user input devices 144 that are operable by passengers or riders (not shown) of the vehicle 140 to provide input used to operate the vehicle suspension and positioning assembly 110 so as to modify the position of the vehicle 140 via cables 128, 129, 130 and/or carriers 120. For example, a passenger may operate the device 144 to provide vehicle control signals 148 (wired or wireless data communication signals transmitted to control system 150) to cause the vehicle 140 to be moved along the track 112 at a particular velocity via operation of the carrier 120 or to cause the vehicle 140 to be moved in one or more of the X-Y-Z axes 141 via operation of one or more of the winches 124 (e.g., to provide transverse or vertical movement to avoid a collision or to follow another vehicle, to provide or move the vehicle 140 with pitch, roll, and/or yaw, or to otherwise operate/position the vehicle 140 in a workspace).

The ride 100 also may include a control system 150 to operate to process the vehicle control signals 148 and to transmit control signals 163 to operate the carriers 120 and/or winches 124 to move the vehicle 140 along the track 112 with a particular body orientation and within a particular (dynamically selected) work space. The control system 150 may include one or more hardware processors 152 that process the vehicle control signals 148 and that process operator input provided via one or more input/output (I/O) devices 154 (e.g., keyboards, mice, touchscreens, touchpads, voice activation devices/software, and the like). The processor 152 may also manage memory 160 of the system 150 that stores one or more ride programs 162 (e.g., software or code devices that cause the system 150 to perform particular functions such as transmitting control signals 163 to selectively operate the carriers 120 and winches 124 to move and position the vehicle 140 along a path defined by the track 112).

The ride programs 162 may be used to define operation of the user input devices 144 such as to define when a passenger may provide input 148 to alter the positioning/operation of the assembly 110 to position/move the vehicle 140. The ride program 162 (or manual operations by an operator via I/O 154), with or without modification based on input signals 148 from user input devices 144, may define a number of parameters that set the position of the vehicle 140 relative to the track and/or affect motion simulated by the ride 100. For example, the ride parameters 170 may include cable length 172 for each cable 128, 129, 130 by operating the winches/cable drives 124, e.g., to play out more cable or to reel in some length of the cables 128, 129, 130, and the length, $L_{Cable}$, is typically independently set by the control system 150 but, in some applications or operating modes, two or more of the cables 128-130 may be kept at a same length (or at some related/proportional length to achieve a desired orientation of the body of the vehicle 140 such as horizontal for loading/unloading, a particular forward or backward slope to simulate a dive or other move of the vehicle, or the like).

Another parameter 170 is carrier position 120 that is used to adjust the location of the vehicle 140 along the path and/or to define a work space for the vehicle 140. Again, this may involve concurrent or independent movement of each of the carriers 120 to set the location of the suspension/anchor points 126 for suspending the vehicle 140. The winch speed for each winch 124 may be set by parameters 176, which varies the cable velocities, $V_{Cable}$, to affect motion of the vehicle 140 (e.g., a rapid and nearly gravity-free fall, a quick or slow roll, or the like). The speed or velocity, $V_{Carrier}$, of each carrier 120 along with travel direction on a track 112 may be set by parameters 178, which may be transmitted by controller 150 via control signals 163 to the assembly 110. Further, the vehicle position 179 along the track 112 may be set by parameters 170 of each ride program 162 and this may be used by the processor 152 to send signals 163 to operate the vehicle suspension and positioning assembly 110 (e.g., match a tracked or sensed position with a desired position 179 for a particular show aspect of a ride program and adjust other parameters (such as carrier speed 178) as needed to match sensed and set vehicle position).

With the system/ride 100 in mind, it can be understood that a common or base set of equipment may be arranged in a number of ways to deliver different ride experiences (or differing ride embodiments). This equipment may include a track that provides a fixed pathway that a carrier travels along. Each ride may have one or more carriers that each provide a mobile platform that travels on or is supported by the track(s). Each carrier may include mechanisms to move the carrier (including power or connections to power) along the track. Each carrier supports a winch system or assembly (including its power and control aspects), and these winches provide a cable management system/assembly capable of changing the length of a cable extending to a support or cable-attachment point/device on a vehicle. Each vehicle is a passenger-carrying structure that is supported by one or more cables extending from a winch on a carrier.

Regarding system configuration, one or more track structures guide one or more carriers per vehicle along a fixed path (e.g., the tracks themselves are typically fixed in place). The carriers each support one or more winch systems that are each capable of dynamically moving a vehicle through a work space that is selectable in a dynamic manner (based on ride program parameters and/or passenger/rider input) by changing the length of the attached cables. The available workspace (e.g., the space through which the vehicle may be moved during operation of the ride) may be changed by moving the carriers along the track, by moving the carriers in relation to the vehicle while keeping the cable length constant, and by operating the winches to change the lengths of the cables (and these steps may be combined/done concurrently). For example, the carriers may be moved independently (or jointly) along the track(s) and the winches may be independently (or in combination/concurrently) operated to modify the cable lengths (or hold one or more at a fixed length at least for a particular operating period or portion of a ride).

A unique aspect of the ride 100 (and other embodiments shown/described herein) is that the rides are operable to (or provide the ability to) change the work space or volume of space that the vehicle can move through as the vehicle is moved relative to the track. At any instantaneous moment in time, a volume of space exists that defines the variety of positions that the vehicle can be moved to by changing the lengths of the various cables that connect the vehicle to the carrier or carriers and the winches. This volume ("work space") can be dynamically changed by independently changing the position of the carriers in relation to the vehicle and/or by operating the winches. This may be done for "experiential" reasons in order to create a desired experience and/or for logistical, operational, and/or safety reasons to guarantee the vehicle will not enter specific areas. Work space for a vehicle is defined by the track, the position of the carriers along the track, the positions of the winches on the carriers (suspension/anchor points), and the length of all the cables used to suspend the vehicle (as well as the support/cable-attachment points on the vehicle body).

The configuration of the vehicle suspension and positioning assembly 110 may be varied widely to practice the ride 100, and, particularly, the number of carriers 120 and winches 124 may be varied (as well as the support points 142 on the vehicles 140) to achieve various cable rigs. For example, a "normal" multipoint suspended cable rig, a "parallelogram" cable rig, or a "Stewart platform" cable rig may be utilized in cases where three or more cables 128-430 are used to suspend the vehicle 140.

In a normal cable rig, a ride vehicle may be suspended by three or more points from a carrier(s) and moved around the 3D space beneath the carrier (as the carrier is held stationary on a track or moved itself along the path defined by the track) using those suspension points. An issue with a normal rig in this application is its tendency to roll or pitch the payload/vehicle as the vehicle moves away from the geometric center of the rig. The only place where the vehicle would have a level floor (be in a horizontal position such as may be used for loading/unloading) is right at a center position, with greater and greater degrees of roll or pitch as it is moved away from center. For aircraft simulation and other similar motion simulator rides where natural roll would make for a more realistic experience, such non-level orientation of the vehicle may be desirable. However, there are other applications where it is desirable to control the roll and pitch independent of the vehicle position within the work space (which, with a normal rig, may require a gimbal or other mechanism in the assembly 140 to correct for roll or pitch away from a center location of the vehicle)

The parallelogram-type rig is similar in form to the normal cable rig in that it may use the same number of winches. However, each of these winches may employ (or deploy) two cables that are attached to the vehicle in a parallelogram geometry. In this way, the vehicle may be maintained in a level, horizontal orientation through a larger portion of its range of motion. Such a rigging may be desirable for some implementations of ride 100 in which a vehicle 140 is moved along a track 112 with the vehicle body kept level (or without roll) and through a varying workspace by changing the lengths of cables 128-130.

The Stewart platform rig employs six winches per vehicle. Stewart platforms are used to provide flight simulators with pistons supporting a platform from below and a similar arrangement may be used (geometrically similar) by suspending a vehicle above using cables rather than supporting the vehicle from below with actuators. This option provides a high degree of flexibility in the motion of the vehicle relate to the carrier(s) and track as it provides a true six-degree-of-freedom setup that provides motion in the X, Y, and Z planes as well as pitch, yaw, and roll. The horizon (or base plane passing through the vehicle body) may be controlled to be in any location in the flight space or work space (e.g., horizontal for loading and unloading and some show portions or at nearly any angle relative to its center/rotation point).

With the above discussion understood, it will be recognized that the present teaching is not limited to this specific rigging implementation. For example, additional rigging options, e.g., using more than the minimum number of winches necessary to implement the desired vehicle motion, exist and can be used to extend the volume through which the vehicle can be positioned beyond that achievable with the minimum rigging. The description is instead intended to provide several representative and useful rigging arrangements that can be used "as-is" or with some modifications to provide a wide variety of rigging arrangements. Further, the description specifically teaches the following rigging arrangements: multiple carriers with single winches on a single track; multiple carriers with multiple winches on a single track; multiple carriers with single winches on multiple tracks; and multiple carriers with multiple winches on multiple tracks. In many implementations, all cables are terminated at the vehicle above the center of gravity (CG) and at the winch system.

Figure 2:
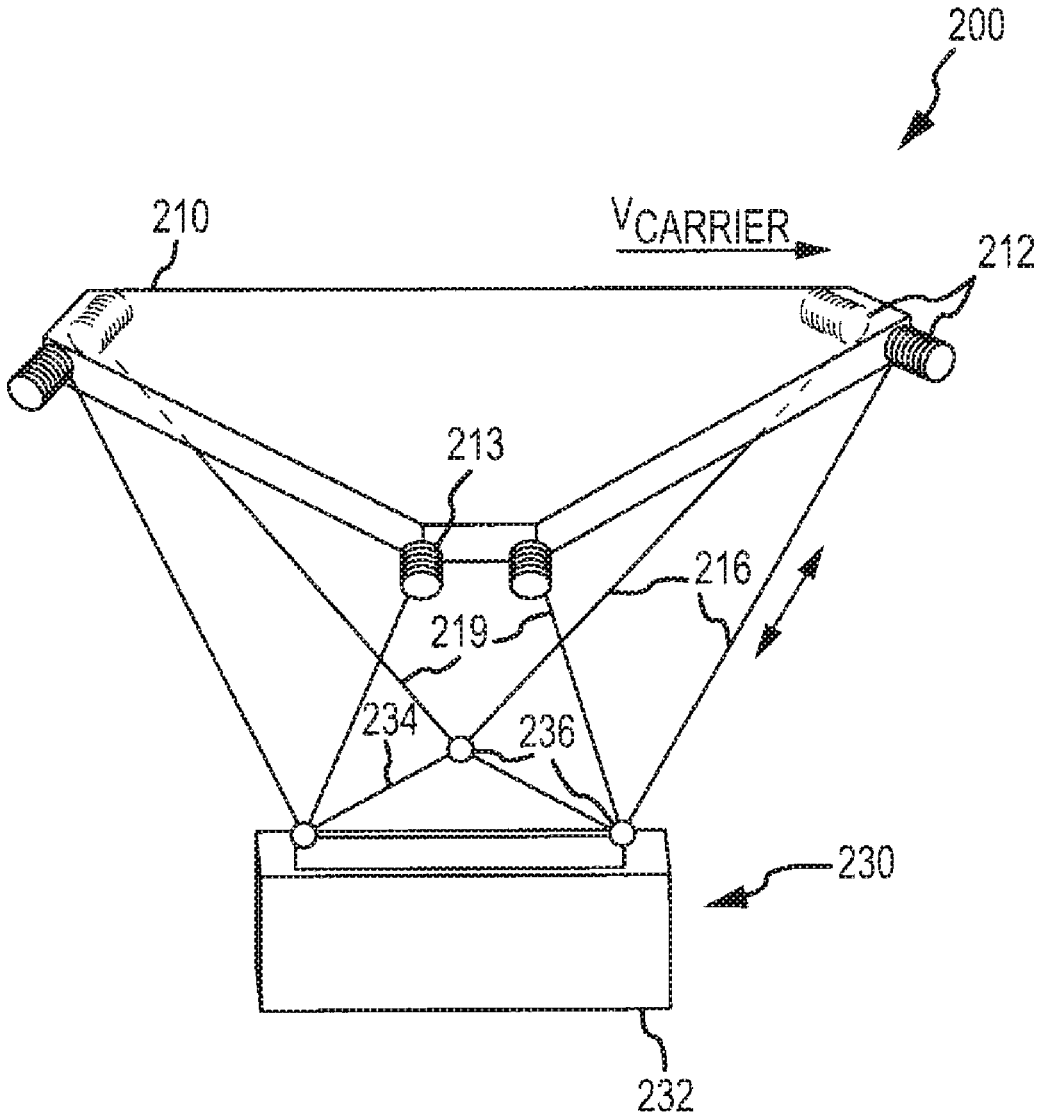
FIG. 2 illustrates schematically a portion of ride system that utilizes a single carrier to support multiple winches/cable drives to selectively position a supported vehicle as the carrier travels along a track (not shown in FIG. 2) or fixed path, with a "Stewart platform" type suspension rig being used in this example.

FIG. 2 illustrates a portion of an amusement park ride 200 that makes use of a Stewart platform-type rig in its vehicle suspension and positioning assembly. As shown, a carrier 210 that is supported upon a track(s) (not shown) is moved at a velocity, along a path defined by the track. On the carrier 210, six winches are supported and selectively control lengths of cables used to suspend a vehicle 230 below the carrier 210. As shown, a pair of winches 212 placed near a forward portion of the carrier 210 is used to provide suspension points for cable 216 that is connected to attachment or support points 236 on the roof or attachment surface 234 of the vehicle body 232.

The winches 212 are independently operable to define the lengths of the cables 216. Another pair of winches 213 is positioned toward the center of the carrier 210 and feed out and reel in another pair of cables 217 that are connected at opposite ends to support points 236 on attachment surface 234 of body 232. As shown, the attachment or support points 236 are arranged in a triangular arrangement with two of the cables 216, 217 extending from differing pairs of the winches 212, 213 to each point 236 (e.g., similar to two ends of actuator/piston arms provided at each support point on a typical Stewart platform). In one embodiment, it is assumed that six winches 212, 213 are used on each carrier 210 to support/suspend each passenger vehicle 230. Based on a simulator vehicle load of 12,000 pounds, each winch 212, 213 would be sized to apply a tension between 0 and about 7000 lbf to cables 216, 217 as the length of the cable is increased or decreased.

Conceptually, this type of rig is similar to a normal motion base ride but with differences that make it considerably more exciting and provide a few surprising results. As discussed above, the miler is moved along a track such that the anchor or suspension points are dynamically selectable to significantly increase the volume of work space for the suspended vehicle. In a suspended configuration versus actuator supported platform, the vertical excursion distance for the vehicle relative to the track is only limited by the height (or depth) of the facility as opposed to the length of the actuators. This allows longer, more sustained periods of acceleration and deceleration, which in turn allow for a more interesting ride experience. In a typical ride setting, without one or more winches provided on the underside of the vehicle (as shown in FIG. 2), acceleration in the downward direction cannot exceed 1 G and, practically, may be limited to not exceed 0.6 G to maintain sufficient cable tension. However, if downward acceleration is desired, one or more winches may be added to the ride to provide a connection from below the vehicle (e.g., a winch or winches on a carrier(s) riding on a separate track below the vehicle 230 in the ride 200 of FIG. 2 used to control downward acceleration).

Regarding ride space, the space limitation for this type of ride is similar to a standard 3D rig along the length of a ride's track (e.g., a space below the track). The space may be kept constant or may be varied along the track length to allow differing motion experiences in differing parts of the ride. The ride is only limited by practical limitations such as how large a ride operator can or wants to make a building and associated machinery. One of the more dramatic aspects for ride passengers may be travel in the vertical (or Z) axis, and, hence, it may be desirable to utilize longer lengths of suspension cables and provide large amounts of space below a track to allow a failing or sudden drop sensation. Specifically, the more height available for the vehicle to work in along the track the more distance and time is available for downward acceleration events. For example, a 12,000 pound vehicle may be able to experience speeds of up to 3 meters/second with acceleration up to 1 G.

Figure 3:
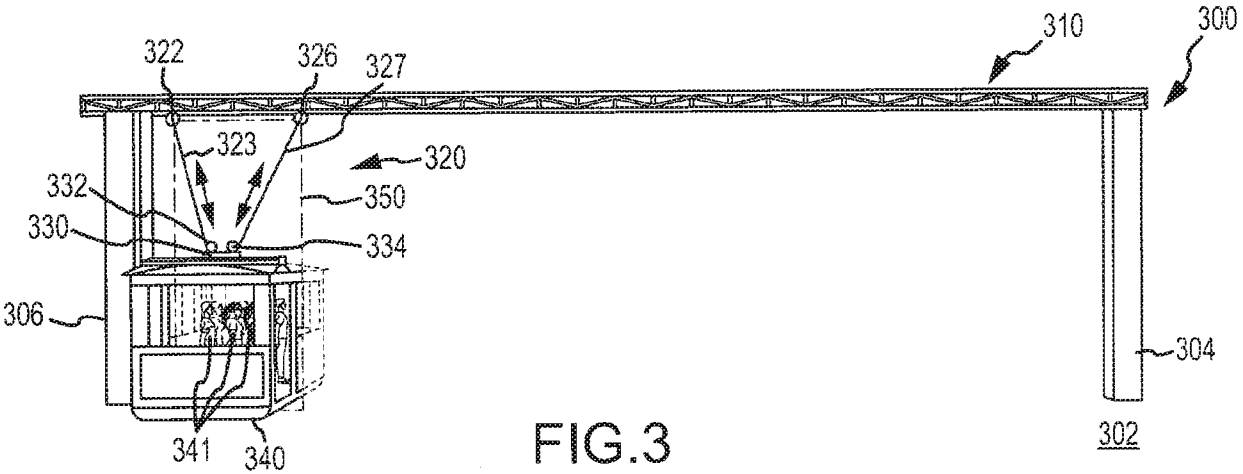
FIGS. 3 and 4 illustrate an embodiment of a cable-suspended vehicle ride system showing use of one track with two independently movable/positionable carriers and two winches (one per carrier) per vehicle.
Figure 4:
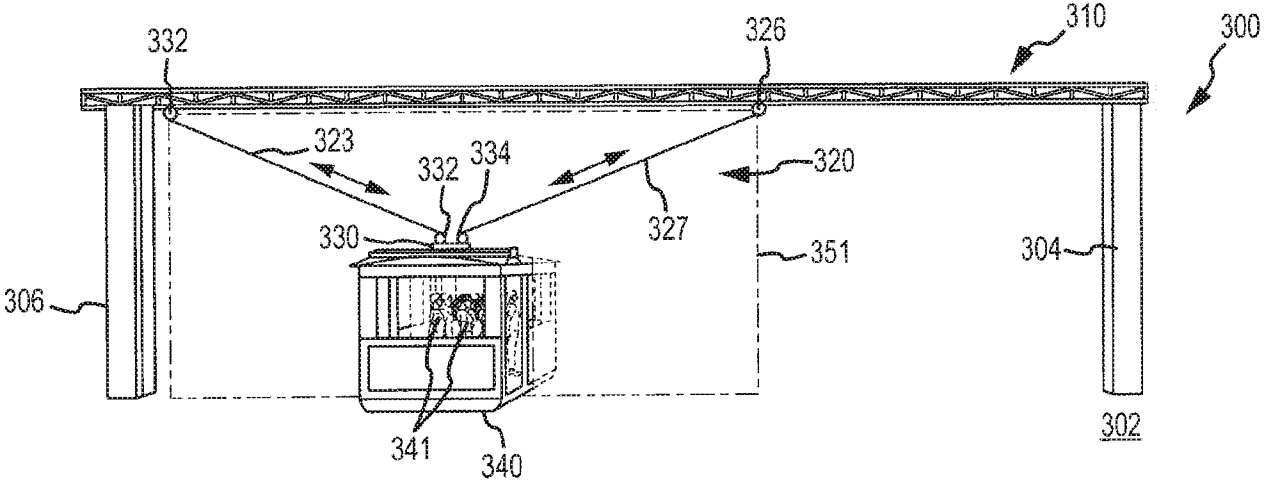

FIGS. 3 and 4 illustrate one embodiment of a ride 300 using the cable-suspended vehicle ideas discussed above. The ride 300 includes a platform or base 302 from which structural elements 304, 306, such as poles or columns, extend upward to support a single track 310 (but the track 310 could also be suspended in the ride 300). The ride 300 includes a vehicle suspension and positioning assembly 320 that includes first and second carriers 326, 332 that each include a winch/cable drive for reeling in and out first and second cables 327, 323. The cables 327, 323 are fixed at opposite ends to cable mounting element 330 on at support or cable-attachment points 332, 334 (spaced apart, pivotal mounts on element 330, which is located above a center of gravity of the vehicle 340). The mounting element 330 is attached to the upper portion of vehicle body 340 that is adapted for carrying one or more passengers 341 (who may be able to provide input used by a control system to adjust operation of the winches and/or carriers 326, 332 to change the position or orientation of the vehicle 340).

The ride 300 is adapted to provide two-dimensional motion between two points n a straight or curved track. In other words, the vertical location of the vehicle 340 may be varied during the movement of the carriers 326 332 along the track 310 but there is no transverse movement. By choosing the spacing between the support points 332, 334 the front end of the vehicle 340 may be caused to be lower or higher than the back end of the vehicle (e.g., by having the lengths of cables 323, 327 be non-equal). Moving one of the carriers 326, 332 while keeping the cables 323, 327 the same length can be used to raise or lower the vehicle. Also, operating one or both of the winches on carriers 326, 332 may be used to raise or lower the vehicle 340 by shortening or lengthening, respectively, the lengths of the cables 323, 327.

Generally, FIG. 3, illustrates a work space 350 that may be provided at load or unload of the vehicle 340 with passengers 341. This smaller workspace may be preferred for vehicle loading or unloading. The work space 350 is relatively small in the direction of the track or ride path but may be as tall or high as allowed by the height or depth provided by the distance between the base 302 and the track 310 (e.g., vertical height or Z-axis dimension of workspace 350 is generally limited by space and limitations of the suspension assembly 320). FIG. 3 shows the work space 350 limited to control vehicle motion for safe loading/unloading of passengers. FIG. 4 shows that the work space 351 may be dynamically changed (here shown enlarged) in size, with the vehicle 340 being positioned throughout the work space 351 by operation of the winches and/or carriers 326, 332 to modify the position/length of the cables 323, 327. For example, the carriers 326, 332 may be moved at differing speeds which would change the vertical position of the vehicle 340 and/or the winches on carriers 326, 332 may be operated to change the vertical distance or to change the orientation of the vehicle 340.

Figure 5:
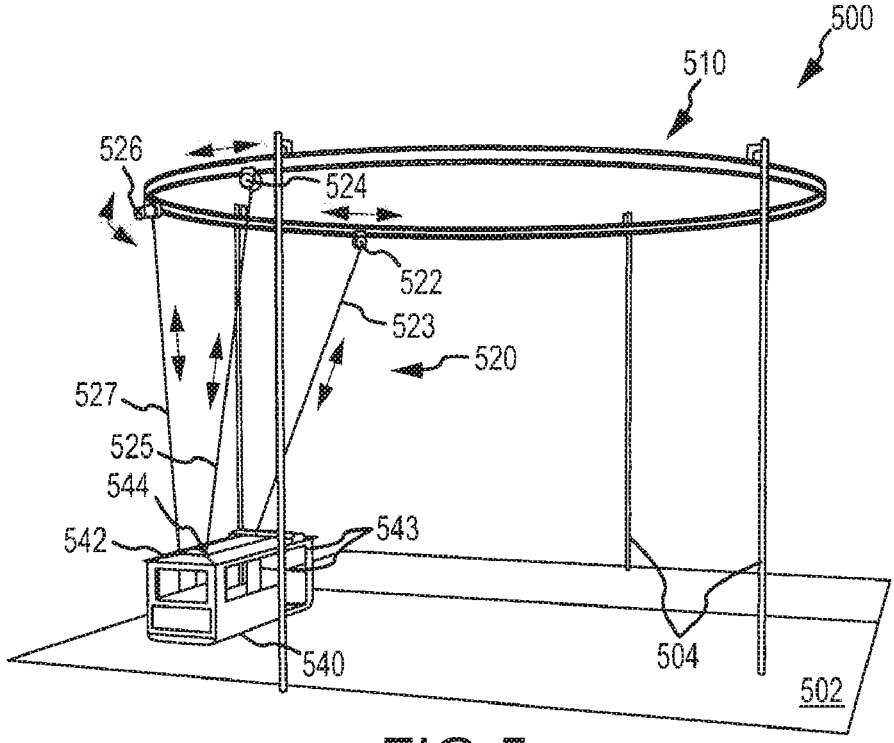
FIGS. 5 and 6 illustrate another embodiment of a cable-suspended vehicle ride system similar to that shown in FIGS. 3 and 4 but using one track combined with three carriers each providing a winch to support and position a passenger vehicle (e.g. to alter cable lengths while the carriers are selectively moved about a path defined by the track to provide a wide range of vehicle positions (or work spaces))
Figure 6:
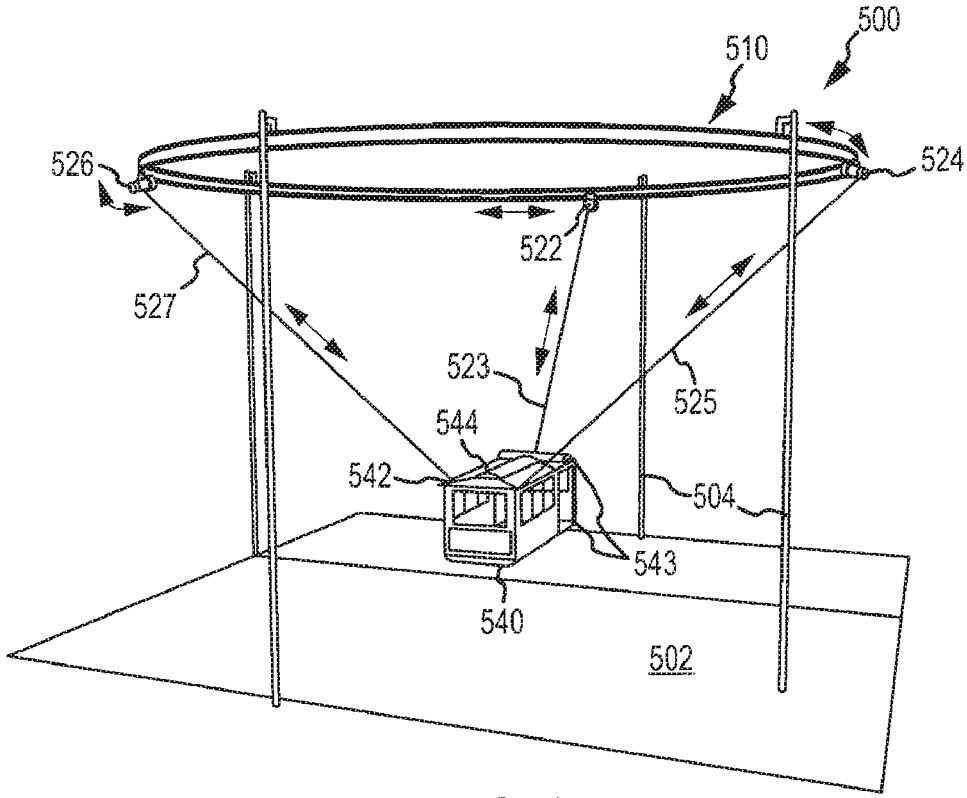

FIGS. 5 and 6 illustrate another embodiment of a ride 500 that may be used to move a passenger vehicle 540 through a dynamically set work space. In this embodiment, a single track 510 is utilized that is supported a vertical distance or height above a base 502 by, in this case, vertical supports/ posts 504. The ride 500 includes three carriers or bogies 522, 524, 526 supporting each vehicle 540 via cables 523, 525, 527. The cables 523, 525, 527 are attached (pivotally affixed) to attachment or support points 543, 544, and 542, respectively, on the top surface of the body of vehicle 540. Each carrier 522, 524, 526 includes a winch or cable drive that is operable to adjust the length of the cables 523, 525, 527. The combination of independent (or concurrent) movement of the carriers 522, 524, 526 on track 510 and independent (or concurrent) operation of the three winches on such carriers to lengthen or shorten the cables 523, 525, 527 allows the work space to be modified such as to move the vehicle from a load/unload position to other positions, as is shown in FIGS. 5 and 6. The work space in these two figures has been modified as the vehicle 540 has been moved through space and the cable suspension system allows the available space to be optimized. For example, the vehicle 540 may simply be hung below the track 510 and follow a circular (in this example) path and/or the entire volume below the track 510 may be used as work space for the ride 500 by movement of carriers and/or operation of winches. In prior rides, the vehicle simply would be support by the carrier and follow the path defined by the track rather than be moved through a dynamically selectable work space below the track 510.

Figure 7:
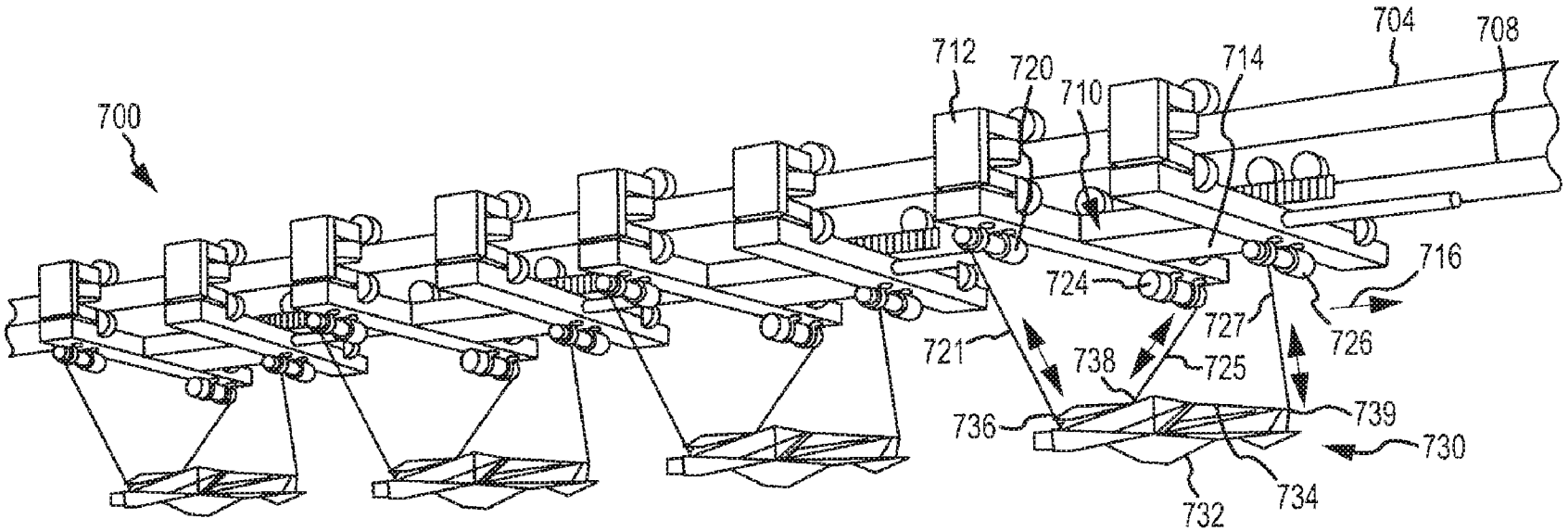
FIG. 7 illustrates a perspective view of a ride system similar to that of FIG. 2 as the system utilizes a single track to support a number of vehicles that are each suspended by a single carrier that uses multiple winches per vehicle (with 3 winches shown in this example)

FIG. 7 shows another embodiment of cable-suspended vehicle ride 700. As shown, the ride 700 includes a single track defined by rails 704, 708, and a single carrier 710 is provided per vehicle 730. Each carrier 710 is rotatably coupled via roller/bogie wheel assemblies 712 contacting rails 704, 708 of the track with a lower body or structural frame 714 extending below to face the vehicle 730. On the carrier 710, three winches 720, 724, 726 are positioned in a triangular formation. Suspension cables 721, 725, 727 extend at variable lengths to attachment/support points 736, 738, 739 on a support surface 734 of the body 732 of the vehicle 730. In this example, the attachment points 736, 738, 739 are also arranged in a triangular pattern with two attached to hind or rear portions (e.g., one each on sides or wings of body 732) and one attached to a forward portion (e.g., a nose of the body 732).

During operation of the ride, the carrier 710 may be positioned along the path defined by the track 704, 708 as shown with movement arrow 716, and this movement may be at a variable or adjustable velocity to provide desired ride effects (e.g., slower during a show portion or a climbing portion and faster during a dive or dropping portion). The winches 720, 724, 726 may be operated separately or together to achieve other ride effects. For example, engine failure of a plane/space ship (or otherwise provide a free or rapid fall) may be simulated by concurrently operating the three winches to drop the vehicle 730 by rapidly reeling out cables 721, 725, 727. A dive (or downward pitch) is simulated by lengthening cable 727 with winch 726 and/or shortening cables 721, 725 with winches 720, 724. A climb (or upward pitch) is provided by shortening cable 727 and/or lengthening cables 721, 725, and roll or other motions are provided by shortening or lengthening the cables 721, 725 at different rates and/or different directions. Each vehicle in the ride 700 may be operated similarly by a controller at similar portions of the ride and/or each vehicle may be operated differently in response to user input (or for other reasons), e.g., one passenger may operate their vehicle differently than another causing to explore a variable work space relative to track 704, 708.

Figure 8:
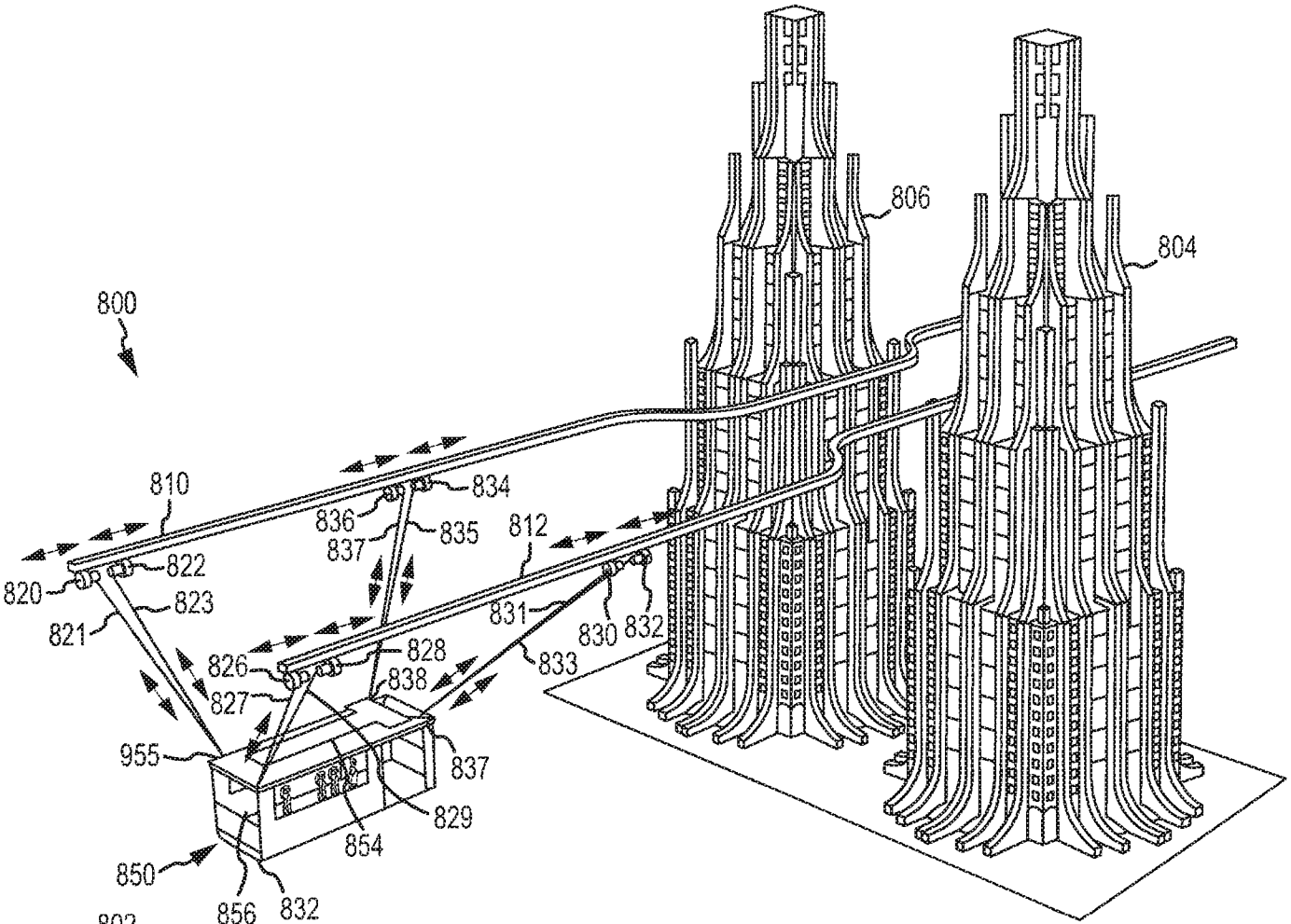
FIGS. 8-10 illustrate a multiple track, multiple carrier, and multiple winch per vehicle embodiment of a cable-suspended vehicle ride system illustrating use of rails locations in combination to winch operations to limit a vehicle to a safe work space in constrained portions of a ride while allowing (through larger track spacing and operation of the winches) a vehicle to be moved through or explore a larger work space in less space constrained portions of the same ride.
Figure 9:
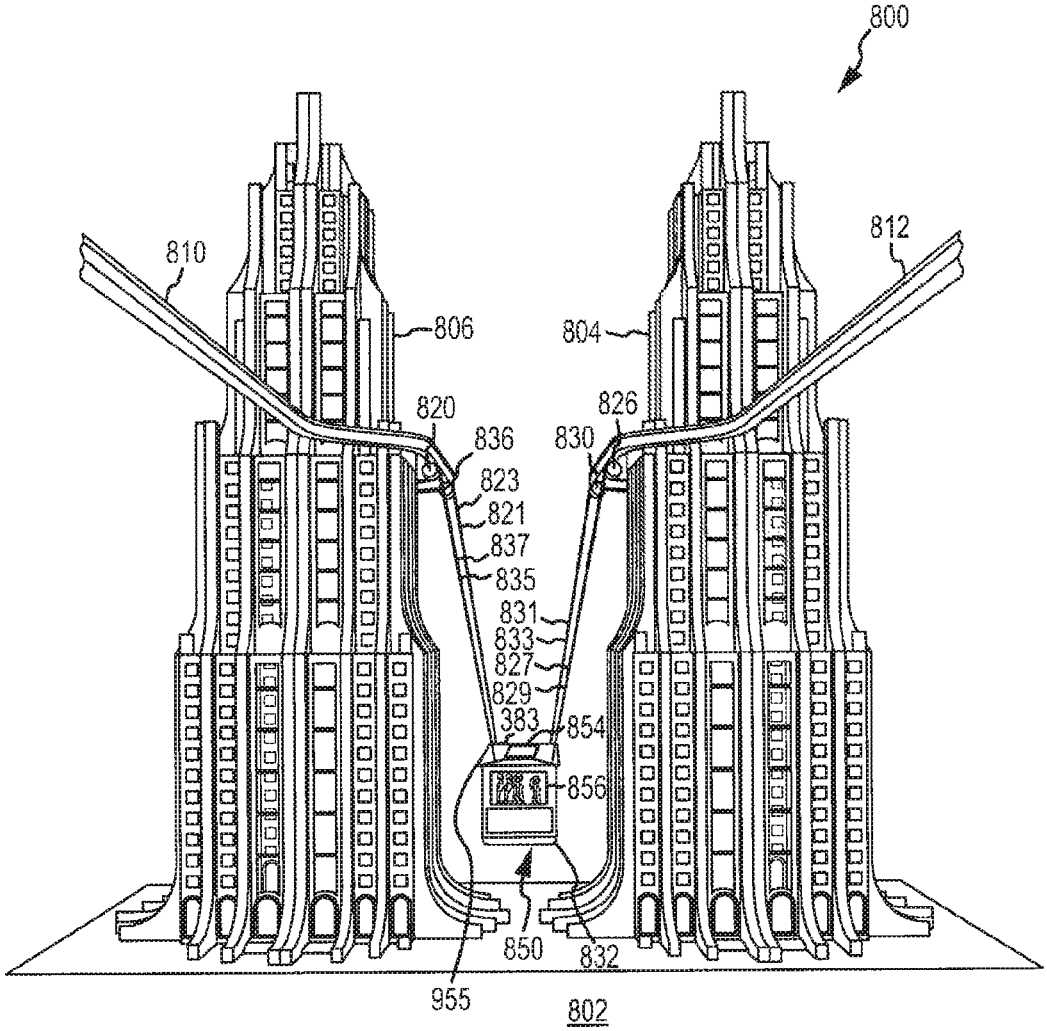
Figure 10:
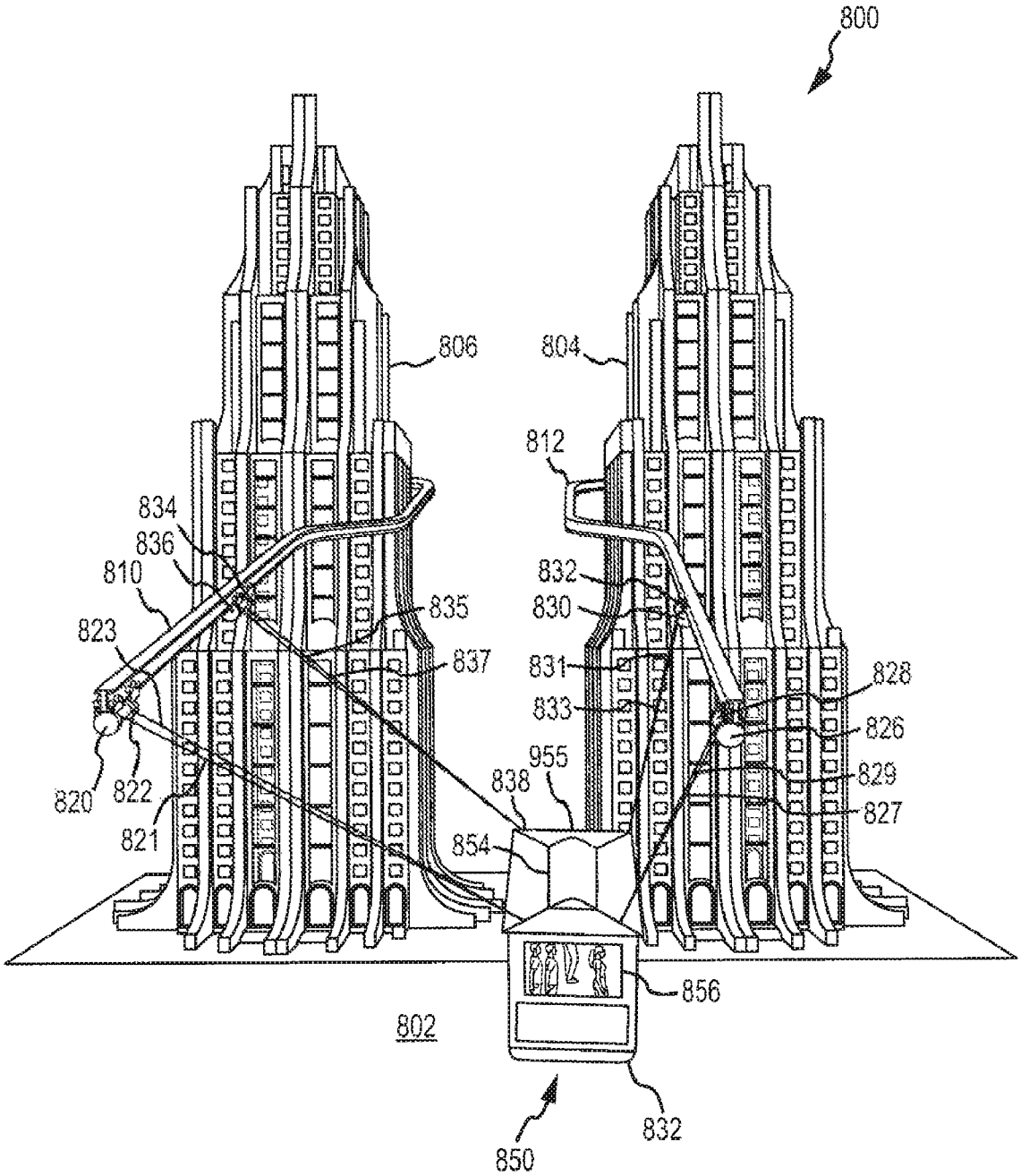

FIGS. 8-10 illustrate a ride 800 in which a vehicle 850 is suspended from first and second tracks 810, 812, which are supported by structural elements 804, 806 above floor or base 802. The ride 800 uses multiple carriers (i.e., four carriers) with eight winches 820, 822, 826, 828, 830, 832, 834, 836 (i.e., eight winches) per vehicle 850. Winches 820, 822 are provided on one carrier that is independently positionable on track 810 as are winches 834, 836. Winches 820, 822 are operable to set the lengths of cables 821, 823 (which are connected to the body 852 on a surface/roof 854 at point 855) while winches 834, 836 are separately operable to set the lengths of cables 835, 837 (which are connected to the roof/surface 854 of body 852 at point 858). On the other side/edge of the vehicle 850, winches 826, 828 are provided on one carrier that is independently positionable on track 812 as are winches 830, 832. Winches 826, 828 are operable to set the lengths of cables 827, 829 (which are connected to the body 852 on a surface/roof 854 at point 856) while winches 830, 832 are separately operable to set the lengths of cables 831, 833 (which are connected to the roof/surface 854 of body 852 at point 857). In this example, the support points 855, 856, 857, 858 are positioned at the four corners of roof/surface 854.

The ride 800 illustrates use of multiple tracks with multiple carriers and multiple winches per carrier for each vehicle. This suspension and positioning assembly is useful for dynamically moving a vehicle 850 through a space or environment in multiple degrees of freedom. In FIGS. 8 and 10, the tracks 810, 812 are spaced farther apart (at a first spacing) and a relatively large vertical distance above the floor/base 802. As a result, a large work space is available for vehicle movement by operation of the carriers and/or winches 820, 822, 826, 828, 830, 832, 834, 836. For example, FIG. 8 shows the vehicle 850 centrally positioned between the tracks 810, 812 while FIG. 10 shows transverse movement relative to a travel or ride path defined by the tracks 810, 812 with the vehicle 850 closer to rail 812 than to rail 810 (e.g., with the winches operated to shorten cables 827, 829, 831, 833 relative to cables 821, 823, 835, 837). All or some of the cables could also be lengthened in FIGS. 8 and 10 to approach or even contact the floor or base 802.

FIG. 9, though, shows how track spacing may be used to constrain a vehicle to a safe work space or safe operating zone. FIG. 9 illustrates the tracks 810, 812 are spaced more narrowly apart (at a second spacing) such as on interior surfaces of support structural elements 804, 806, and, when the cables suspending the vehicle 850 are retained at the same lengths as at the wider spacing portions of track 810, 812 shown in FIG. 8, the vehicle 850 is lowered to a vertical position closer to the floor 802 (or further from tracks 810, 812). In other words, spacing of tracks 810, 812 may be used to set the vertical position (or to modify the work space) of the vehicle 850 along the path defined by the tracks 810, 812. It may also be desirable to maintain or even reduce the vertical distance from the tracks 810, 812 as the vehicle 850 travels between structures 804, 806 or through a station area where guests load and unload the vehicle. In such a case, the winches 820, 822, 826, 828, 830, 832, 834, 836 may be operated to reel in cable to reduce the distance between the vehicle 850 and the tracks 810, 812 (e.g., shorten the lengths of the cables equally to keep the vehicle horizontally level or shorten by two or more amounts to cause pitch, tilt, yaw, and/or heave of the vehicle 850).

The above description teaches rides in which cable-suspended passenger vehicles may be suspended by two or more cables where each cable is either a single cable or multiple cables operating in parallel or unison. The attachment or support point at which the cables are attached to the vehicle body is typically fixed but the anchor or suspension point is movable during operation of the ride to allow a much larger work space to be defined for each vehicle and/or to achieve a range of vehicle movements. To this end, each cable has its length set by a winch system and carriers or vehicle bogies that are independently driven support one or more of the winch systems such that as the carriers move along a ride track the anchor points for the cables are also moved or changed. Additionally, each winch system may be operated independently or concurrently with other winch systems to alter the lengths of the cables used to suspend the vehicle.

Hence, the X-Y location (transverse motion) of the vehicle relative to the ride path may be altered as may be the Z or vertical location relative to the track (or to a floor/base for the ride), e.g., a 3D motion or work space volume can be dynamically varied for each vehicle as it travels along a ride track (e.g., a vertical drop of 2 to 100 feet being readily obtainable with cables and winch systems as well as transverse movements limited only by the span between portions of the track (see FIGS. 5, 6, and 8-10) and movements along the track path (Y direction, for example, may along the track or ride path) only limited by spacing achievable between carrier.

In some applications, safety redundancies may require a ride to separate a single cable into 2, 3, or more separate cables and/or winch assemblies that act as a single system (e.g., similar to the system shown in FIG. 8). Hence, it will be understood that each of the embodiments taught herein may be modified to provide such redundancies (e.g., replace a single cable with 2 or 3 cable/winch assemblies that provide a similar functionality such as by replacing the carrier w/winch 522 and cable 523 with two winches on carrier 522 that provide a pair of cables to vehicle 540). Such modifications are considered covered within the breadth of the following claims.

We claim:

1. A ride system for moving a passenger vehicle through a variable work space, comprising:

a track defining a fixed path for the ride system;

a carrier supported on the track and driven to move along the fixed path from a first position to a second position during operation of the ride system;

first and second winch systems mounted on the carrier, the first and second winch systems being operated to set a length of a first cable and a length of a second cable extending outward from the first and second winch systems, respectively; and a passenger vehicle with a body having first and second attachment points for the first and second cables, respectively, wherein the first and second winch systems provide first and second points for suspension of the passenger vehicle, the suspension points moving along the fixed path during operation of the ride system.

2. The ride system of claim 1, wherein the first attachment point is distal to the second attachment point on the body, whereby the body pitches or rolls when the length of the first cable differs from the length of the second cable, and wherein the first and second winch system are operated independently to set the lengths of the first and second cables.

3. The ride system of claim 1, wherein the first and second winch systems are operated concurrently at a same rate such that the lengths of the first and second cables are equal as the carrier travels from the first position to the second position, whereby the body is maintained in a horizontal position over a range of vertical distances from the track.

4. The ride system of claim 1, wherein the first and second winch systems are operated independently as the carrier travels from the first position to the second position, whereby the body pitches, rolls, or yaws between the first and second positions.

5. The ride system of claim 1, further comprising a third winch system mounted on the cattier controlling a length of a third cable extending from a third suspension point on the carrier to a third attachment point on the body of the passenger vehicle, wherein the first, second, and third winch systems are independently and concurrently operable.

6. The ride system of claim 5, wherein the second and third attachment points are spaced apart and provided on a first end of the body and the first attachment point is provided on a second end of the body.

7. The ride system of claim 1, further comprising third, fourth, fifth, and sixth winch systems mounted on the carrier and controlling lengths of third, fourth, fifth, and sixth cable attached at opposite ends to third, fourth, fifth, and sixth attachment points on the body of the passenger vehicle, wherein positions of the winch systems on the carrier and positions of the attachment points on the body are selected such that winch systems are operable as a Stewart platform-type rigging for moving the body relative to the track.

8. A ride assembly, comprising:

a track defining a path;

first and second carriers supported on the track that are independently driven to position the first and second carriers at differing positions along the path defined by the track;

first and second winch systems positioned on the first and second carriers, respectively, and operating to define lengths of first and second cables; and a passenger vehicle with a body having first and second attachment points for the first and second cables, respectively.

9. The assembly of claim 8, wherein the first and second attachment points are proximate to each other and a center of gravity of the body and wherein the first and second winches are concurrently operated to maintain the length of the first cable substantially equal to the length of the second cable.

10. The assembly of claim 8, the path defined by the track is an enclosed loop and wherein the winch systems are operable to position the body of the passenger vehicle in a plurality of positions in a work space defined by the loop and a vertical distance extending below the track.

11. The assembly of claim 10, wherein the winch systems are independently and concurrently operable to set the lengths of the first, second, and third cables and wherein the lengths are each selectable from a predefined range to be equal or to differ during movement of the carriers along the path and at the differing positions.

12. The assembly of claim 8, further comprising a second rail spaced apart two or more distances along a corresponding two or more portions of the path and wherein the first carrier is supported on the second rail.

13. The assembly of claim 12, further comprising a fourth carrier supported on the second rail independently driven relative to the first, second, and third carriers and a fourth winch system positioned on the fourth carrier independently operating to define a length of a fourth cable attached to the body of the passenger vehicle at a fourth attachment point.

14. The assembly of claim 13, wherein the first, second, third, and fourth attachment points are spaced apart and arranged in a rectangular pattern on a surface of the body.

15. The assembly of claim 13, wherein at least one of the lengths of the first, second, third, and fourth cables differs from the other three lengths at least during a portion of the path defined by the track.

16. A method of positioning a vehicle relative to a track in an amusement park ride, comprising:

suspending a vehicle for passengers using at least two cables extending from anchor points on one or more carriers supported by a track, the anchor points each defined by an outlet of a winch;

driving the one or more carriers along track, whereby the vehicle is moved through a work space below the track; and during the driving, operating at least one of the winches to change a length of a corresponding at least one of the cables, whereby the work space is dynamically modified as the vehicle is moved along the track.

17. The method of claim 16, wherein the driving and the operating steps are performed in response to control signals from a control system, the control signals at least partially being derived from user input provided by one of the passengers in the vehicle.

18. The method of claim 16, wherein at least three cables are used in the suspending step and wherein during the operating step each of the three winches associated with the cables are independently operable such that at least three differing ones of the lengths for the cables are defined, whereby the work space is dynamically modified and an orientation of the vehicle relative to the track is also modified during the driving.

19. The method of claim 16, wherein at least six cables are used in the suspending and attachment points are selected on the body such that the operating step may be performed to control positioning of the body relative to the track as a suspended Stewart platform.

20. The method of claim 16, wherein two or more carriers are used during the suspending step and wherein, during the driving step, each of the two or more carriers are driven at differing velocities.

21. The method of claim 16, wherein each of the winches are operated during the operating step to modify the lengths of the cables and wherein the winches are operated such that the lengths of the cables are modified at differing rates.

22. The method of claim 16, wherein two or more of the carriers are provided for suspending the vehicle with the cables terminating at the vehicle above a center of gravity of the vehicle and at the outlets of the winches and wherein the two or more carriers are supported by the track and at least one additional track.

* * * * *